US008068629B2

(12) United States Patent
Klinkby et al.

(10) Patent No.: US 8,068,629 B2
(45) Date of Patent: Nov. 29, 2011

(54) HEARING AID AND METHOD OF UTILIZING GAIN LIMITATION IN A HEARING AID

(75) Inventors: Kristian Tjalfe Klinkby, Vaerloese (DK); Peter Magnus Norgaard, Frederiksberg (DK); Helge Pontoppidan Foeh, Stenlose (DK); Thilo Volker Thiede, Ballerup (DK)

(73) Assignee: Widex A/S, Lynge (DK)

( * ) Notice: Subject to any disclaimer, the term of this patent is extended or adjusted under 35 U.S.C. 154(b) by 778 days.

(21) Appl. No.: 12/185,898

(22) Filed: Aug. 5, 2008

(65) Prior Publication Data

US 2008/0298615 A1 Dec. 4, 2008

Related U.S. Application Data

(63) Continuation-in-part of application No. PCT/EP2006/060433, filed on Mar. 3, 2006.

(51) Int. Cl.
*H04R 25/00* (2006.01)

(52) U.S. Cl. ..... 381/318; 381/93

(58) Field of Classification Search ..... 381/66, 381/83, 91, 92, 93, 95, 96, 313, 317, 318, 381/356, 357, 358

See application file for complete search history.

(56) References Cited

U.S. PATENT DOCUMENTS

| | | | | |
|---|---|---|---|---|
| 6,219,427 | B1 | 4/2001 | Kates | |
| 6,498,858 | B2 | 12/2002 | Kates | |
| 7,688,985 | B2 * | 3/2010 | Roeck | 381/92 |
| 2001/0002930 | A1 | 6/2001 | Kates | |

FOREIGN PATENT DOCUMENTS

| | | | |
|---|---|---|---|
| WO | 94/09604 | | 4/1994 |
| WO | 99/26453 | | 5/1999 |
| WO | 02/25996 | A1 | 3/2002 |
| WO | 2005091675 | A1 | 9/2005 |

OTHER PUBLICATIONS

Rafaely, Robust compensation with adaptive feedback cancellation in hearing aids, Jan. 2003, Elsevier, Speech Communication 39, pp. 163-170.*

* cited by examiner

*Primary Examiner* — Davetta W Goins
*Assistant Examiner* — Phan Le
(74) *Attorney, Agent, or Firm* — Sughrue Mion, PLLC

(57) ABSTRACT

A hearing aid (200) with multiple microphones comprises a first microphone (1) for converting sound into a first audio signal, a second microphone (20) for converting sound into a second audio signal, directional processing means for combining the first and said second audio signal according to a mixing ratio to form a spatial signal, estimating means for estimating a first acoustic feedback signal entering the first microphone and a second acoustic feedback signal entering the second microphone, processing means (4) for processing said spatial signal by applying a gain not exceeding a resulting maximum gain limit to form a hearing loss compensation signal, wherein the resulting maximum gain limit is derived from the first and second acoustic feedback signals and the mixing ratio, and an output transducer (3) for converting the hearing loss compensation signal into an acoustic output. The invention further provides a method and a computer program product.

20 Claims, 5 Drawing Sheets

HEARING AID AND METHOD OF UTILIZING GAIN LIMITATION IN A HEARING AID

RELATED APPLICATIONS

The present application is a continuation-in-part of application No. PCT/EP2006/060433, filed on 3 Mar. 2006 and published as WO-A1-2007098808.

BACKGROUND OF THE INVENTION

1. Field of the Invention

The present invention relates to hearing aids. The invention further relates to methods of utilizing gain-limitation in hearing aids. The invention, more particularly relates to hearing aids incorporating multiple microphones that are adapted to interpolate a maximum gain limit in dependency of the mixing ratio of the microphone signals. The invention still more particularly, relates to hearing aids further incorporating feedback cancellation in order to reduce disturbances due to acoustic feedback, and respective methods thereof.

2. The Prior Art

It is a widely known problem in hearing aid design to adjust the maximum possible amount of gain with which an acoustic input signal may be amplified to produce a hearing loss compensation signal without the appearance of artifacts cased by acoustic feedback or other acoustic disturbances. This is in particular a problem in hearing aids that incorporate multiple microphone branches each having a microphone providing a feedback path. Therefore, a gain safety margin is generally required in order to avoid that the feedback loop approaches the border of stability, the point of generating undesired and annoying sounds.

WO-A-94/09604 discloses a hearing aid with digital, electronic compensation for acoustic feedback which comprises a compensation circuit. The circuit monitors the loop gain and regulates the hearing aid amplification so that the loop gain is less than a constant K. An adaptive filter operates to minimize the correlation between input and output from the hearing aid and may be used to give a measure of the attenuation in the acoustic feedback path by deriving gain, and possibly also phase, characteristics from a feedback cancellation filter.

WO-A-02/25996 discloses a hearing aid with an adaptive filter for suppression of acoustic feedback. The adaptive filter may be used as an independent measuring system to estimate the acoustic feedback signal without distortion of the processed acoustic input signal.

These data may be used to determine loop gain and then set an upper limit on the applicable gain that may be used in each of multiple evaluated frequency bands.

Also, U.S. Pat. No. 6,498,858 discloses how feedback cancellation may be applied to a system with two omni-directional microphones.

Neither of these publications discloses, however, how maximum gain limit values can be determined in multi-microphone systems.

WO-A-99/26453 discloses a feedback compensation system for a hearing aid with two microphones and directional processing, wherein each microphone signal is independently feedback compensated before processing in a directional controller. Independently compensating each microphone signal before directional processing requires extensive processing and carries a risk that an imperfect compensation of the feedback signals will result in a residual feedback signal component, which may interfere with the function of the directional controller.

Thus, there is a need for improved hearing aids as well as improved techniques for utilizing gain-limitation in multi-microphone hearing aids.

SUMMARY OF THE INVENTION

It is therefore an object of the present invention to provide hearing aids and methods of processing signals from a plurality of microphones in a hearing aid taking in particular the mentioned requirements and drawbacks of the prior art into account.

It is in particular an object of the present invention to provide a hearing aid incorporating multiple microphones, input transducers or input sensors with processing means that combines directional processing capability with gain limitation capability. It is a further object of the present invention to provide a corresponding method, for processing of input signals from multiple microphones in a hearing aid, with improved gain limitation.

It is still another object of the present invention to provide a hearing aid incorporating multiple microphones, input transducers or input sensors with processing means that combines directional processing capability with feedback compensation and gain limitation capabilities. It is a further object of the present invention to provide a corresponding method, for processing of input signals from multiple microphones in a hearing aid, with improved gain limitation.

It is yet another object of the present invention to provide a hearing aid incorporating multiple microphones, input transducers or input sensors producing input signals, wherein the input signals are processed in a directional controller and wherein feedback compensation and gain limitation are performed without adversely affecting the function of the directional controller.

It is also an object of the invention to provide a hearing aid wherein overall gain limitation may be performed by a processing means of the hearing aid and where the total system complexity—evaluated e.g. as a processor load or gate count—is comparatively low.

According to a first aspect of the present invention, there is provided a hearing aid that has a first microphone for converting sound into a first audio signal, a second microphone for converting sound into a second audio signal, directional processing means for combining the first and said second audio signal according to a mixing ratio to form a spatial signal, estimating means for providing an estimate of a first acoustic feedback signal entering the first microphone and an estimate of a second acoustic feedback signal entering the second microphone, processing means for processing said spatial signal by applying a gain not exceeding a maximum gain limit to form a hearing loss compensation signal, wherein the maximum gain limit is derived from the estimates of the first and second acoustic feedback signals and the mixing ratio, and an output transducer for converting the hearing loss compensation signal into an acoustic output.

This hearing aid permits determining the resulting maximum gain limit for the overall system by interpolating the first and second acoustic feedback signals in dependency of the mixing ratio of the input audio signals. According to an embodiment of the present invention, the processing means is adapted to determine a maximum gain limit value for the acoustic feedback signal in each microphone branch and to derive the maximum gain limit by interpolation from the maxgain values determined in each branch according to the mixing ratio.

According to a second aspect of the present invention, there is provided a hearing aid which comprises a first microphone for converting sound into a first audio signal, a second microphone for converting sound into a second audio signal, estimating means for estimating a first acoustic feedback signal entering the first microphone to generate a first estimated feedback signal and for estimating a second acoustic feedback signal entering the second microphone to generate a second estimated feedback signal, combining means for combining the first audio signal with the first estimated feedback signal and the second audio signal with the second estimated feedback signal to form first and second feedback compensated audio signal, processing means for combining the first and second feedback compensated audio signals according to a mixing ratio to form a hearing loss compensation signal by applying a gain not exceeding a maximum gain limit; wherein the maximum gain limit is derived from the first and second estimated feedback signals and the mixing ratio, and an output transducer for converting the hearing loss compensation signal into an acoustic output.

This hearing aid enables providing directional processing of the input audio signals by the combining means together with feedback compensation and gain limitation by the processing means which calculates the hearing loss compensation signal, applying a resulting maximum gain limit depending on the mixing ratio applied by the combining means.

According to an embodiment, feedback cancellation may be applied to at least two input sensors, one having an omni-directional and one having a bi-directional characteristic according to directional processing means. The resulting directional characteristic is obtained by mixing the two output signals from the each of the preferably fixed directional sensors—one fixed sensor preferably being omni-directional—in the desired mixing ratio. The mixing ratio may be determined by an adaptive directional controller applying adaptive signal level minimization techniques.

According to a third aspect of the present invention, there is provided a method of processing signals from a first and a second microphone in a hearing aid, wherein the method comprises the steps of converting input signals from the first and the second microphones into a first and a second audio signal, combining the first and the second audio signal according to a mixing ratio to form a spatial signal, providing an estimate of a first acoustic feedback signal entering the first microphone and an estimate of a second acoustic feedback signal entering the second microphone, processing the spatial signal by applying a gain not exceeding a maximum gain limit to form a hearing loss compensation signal; wherein the maximum gain limit is derived from the estimates of the first and second acoustic feedback signals and the mixing ratio, and converting the hearing loss compensation signal into an acoustic output.

It may be seen as a true advantage that the hearing aid, the system and the method according to the present invention provide the ability to automatically adjust the amount of gain that the hearing aid or system may apply—at any given instance. This implies that the hearing aid is able to adjust the possible maximum gain limit from the currently calculated acoustic feedback signals and the mixing ratio between them at any time during operation of the hearing aid.

According to a fourth aspect of the invention, there is provided a computer program product, containing executable program code which, when executed on a computer, executes a method of processing signals from a first and a second microphone in a hearing aid, comprising: converting input signals from the first and the second microphones into a first and a second audio signal; combining said first and said second audio signal according to a mixing ratio to form a spatial signal; providing an estimate of a first acoustic feedback signal entering said first microphone and an estimate of a second acoustic feedback signal entering said second microphone; processing said spatial signal by applying a gain not exceeding a maximum gain limit to form a hearing loss compensation signal; wherein said maximum gain limit is derived from the estimates of said first and second acoustic feedback signals and said mixing ratio; and converting said hearing loss compensation signal into an acoustic output.

Further specific variations of the invention are defined by the further dependent claims.

Other aspects and advantages of the present invention will become more apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

When describing the invention according to embodiments thereof, terms will be used which are described as follows.

Input sensors: in general either directional or non-directional microphones may be used as input sensors. It is commonly known how a directional sensor characteristic (a directional microphone) can be generated by combining the output of two—or more—omni-directional (i.e. non-directional) microphones through a gain- and/or phase-adjustment processor/circuit.

Maxgain or maximum gain limit: the upper limit on which gain it is possible to apply without the occurrence of feedback resonance. Some safety margin (e.g. 12 dB) may be subtracted from the calculated limit.

$|x|_{dB}$: this mathematical operator is shorthand for conversion to logarithmic values, i.e. $|x|_{dB}=20 \log|x|$.

Interpolation: in the context of this document, the term "Interpolation" is used in the sense of "weighed combination", which may be generic to other interpretations of the word. The exact meaning of the term should be deducted from the description in this document.

Figure 1:
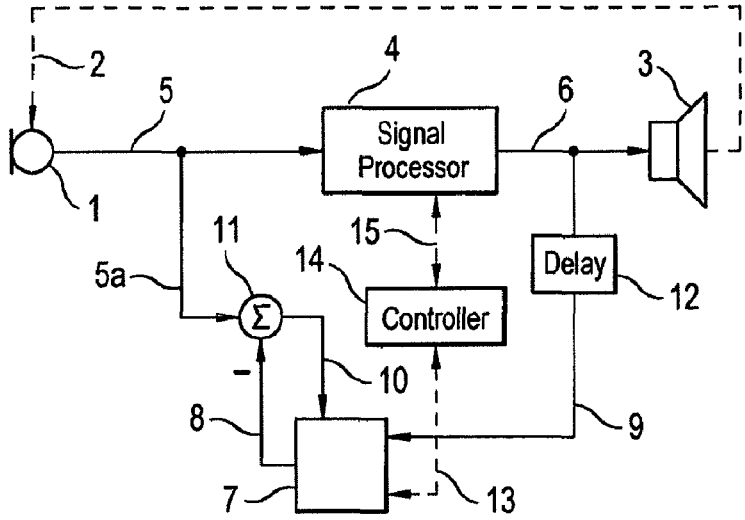
PRIOR ART FIG. 1
FIG. 1 is a schematic block diagram of a hearing aid according to the prior art.

Reference is made to FIG. 1 for an explanation in some detail of prior art WO-A-02125996, and more particularly about how an estimate of gain in the acoustic feedback path may be determined. The microphone 1 is subject to acoustic feedback propagating through feedback path 2 from the receiver 3. In addition to the desired signal, this feedback signal is transmitted to the signal processor 4 as input signal 5. After processing in the signal processor 4 the processor output signal 6 is transmitted to the receiver 3 for conversion to an acoustic output signal. An adaptive filter 7 operates to minimize cross-correlation between input 5*a* (usually referenced as U) and output 6 (usually referred to as the reference signal Y), and consequently generate an estimate 8 of the acoustic feedback signal. By analysis of the transfer function of this filter an estimate of gain in the feedback path can be obtained. The adaptive filter operates to minimize the so-called error signal 10 (ϵ) which is generated by subtracting the estimate 8 from the input signal 5*a* in a subtractor 11.

Figure 2:
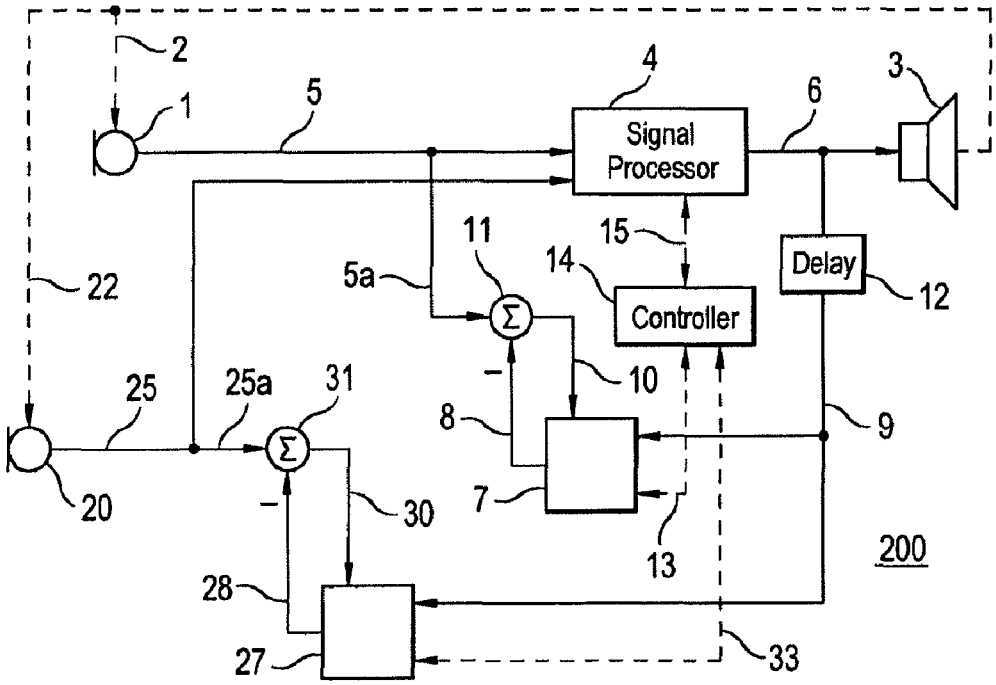
FIG. 2 is a schematic block diagram of a hearing aid according to a first embodiment of the present invention.

Reference is now made to FIG. 2, which shows a hearing aid 200 according to the first embodiment of the present invention which is capable of determining an estimate of the gain in the acoustic feedback path. The hearing aid comprises two microphones 1, 20 as input sensors each producing an audio signal 5, 25 which is transmitted to signal processor 4. The signal processor 4 comprises directional processing means for combining the audio signals 5, 25 according to a mixing ratio to form a spatial signal and processing means to form a hearing loss compensation signal from the spatial signal. The hearing loss compensation signal is then transmitted as processor output signal 6 to the receiver or output transducer 3 for conversion to an acoustic output signal. The acoustic output signal may propagate, at least in part, along a feedback path 2, 22 for each microphone branch of the microphones 1, 20. For each microphone branch, an adaptive filter 7, 27 operates to minimize cross-correlation between the respective input signal 5*a*, 25*a* (usually referenced as U) and processor output signal 6 (usually referred to as the reference signal Y), and generates an estimate 8, 28 of the acoustic feedback signal. By analysis of the transfer function of each the filters 7, 27 an estimate of the gain in each feedback path 2, 22 can be obtained. The adaptive filters 7, 27 operate to minimize the so-called error signal 10, 30 (ϵ) which is generated by subtracting the estimate 8, 28 from the input signal 5*a* in a subtractor 11, 31. The amount of acoustic feedback may be estimated by determination of a parameter like the ratio between the input and output signal of the respective filter 7, 27. The way of implementing such filters will be known to the person skilled in the art, e.g. from the disclosure in WO-A-02/25996. The estimated acoustic feedback signals are then provided to the signal processor for calculation of the maximum gain limit taking into account the mixing ratio applied by the directional processing means when producing the current spatial signal.

According to the embodiment shown in FIG. 2, a controller 14 is provided as further estimating means and adapted to estimate the attenuation of the first acoustic feedback path to the first microphone 1 and of the second acoustic feedback path to the second microphone 20. The controller is adapted to estimate the attenuation by determining a parameter of each of the adaptive filters 7, 27 submitted to the controller 14 (illustrated by dotted lines 13, 33). Based on the received parameter, the controller 14 calculates a maxgain value for each feedback path which is then submitted to the signal processor 4 (illustrated by dotted line 15). The processing means in the signal processor 4 then processes the spatial signal by applying a gain which is adjusted to not exceed a resulting maximum gain limit. The resulting maximum gain limit is derived by interpolation of the maxgain values according to the mixing ratio applied by the directional processing means to produce the current spatial signal with the desired directional characteristic.

It is also important to realize that according to the embodiment as shown in FIG. 2, no subtraction of the estimated feedback signal is done in respect of the input signals 5, 25 to the signal processor 4. This is an important advantage of the embodiment shown in FIG. 2 since the output signals 8, 28 of the filters 7, 27 are not fed into the main signal path from the microphones 1, 20 to the output transducer 3.

According to an embodiment, the input sensors 1, 20 may be either two omni-directional microphones or two directional microphones. The output signals from the sensors are transferred to the signal processor 4 wherein these signals are combined to generate a spatially filtered signal. This combination is typically done according to the well-known "delay and subtract" technique by the directional processing means of the signal processor 4. A general description of the combination process would be:

$$U_{spatial}=c_1U_1-c_2U_2 \tag{1}$$

i.e. each input signal ($U_1$, $U_2$) is multiplied with a complex number ($c_1$, $c_2$) and the spatially filtered signal ($U_{spatial}$) is generated by subtracting one modified signal from the other. Usually, the coefficients are selected as $[c_1, c_2]=[1, \alpha]$, $\alpha$ being of size 1 and some appropriate angle.

The combination process may be controlled either manually (adjustably) or automatically (adaptively). It is known that an adaptive control can be performed with an output-minimization technique. According to an embodiment employing an adaptive directional control system, an adaptive spatial filter will be provided the coefficients of which will be calculated by the adaptive control system, e.g. by an LMS signal minimization method. According to an embodiment employing an adjustable directional control system, the coefficients of the filter are selected according to an input to the adjustable control system, e.g. by the user turning a control-wheel etc.

Each adaptive filter 7, 27 generates an estimate of the acoustic feedback signal that enters the respective sensor branch 5, 25. Calculations, based on either the filter coefficients or the input-output ratio of the signals 8, 9, 28 in the filters, can thus provide an estimate of the attenuation in each feedback path 2, 22. Knowing this attenuation the maxgain may be estimated according to the following. Since the ratio of feedback signal ($X_1$, $X_2$) to the output signal from the hearing aid ($Y_o$) represents the gain (rather: attenuation) in each acoustic feedback path, a set of maxgains may be calculated according to:

$$\left[-\left|\frac{X_1(j\omega)}{Y_0(j\omega)}\right|_{dB}, -\left|\frac{X_2(j\omega)}{Y_0(j\omega)}\right|_{dB}\right] \tag{2}$$

In order to simplify this evaluation, the calculation may be replaced by:

$$\left[-\left|\frac{X_1(j\omega)}{Y_0(j\omega)}\right|_{dB}, -\left|\frac{X_2(j\omega)}{Y_0(j\omega)}\right|_{dB}\right] \tag{3}$$

According to an embodiment, wherein a hearing aid having band split architecture with i frequency bands is used, this calculation may be replaced by signal-power evaluation in each band:

$$[\text{max gain}_{1i}, \text{max gain}_{2i}] = \left[-\left|\frac{|X_{1i}|}{|Y_{0i}|}\right|_{dB}, -\left|\frac{|X_{2i}|}{|Y_{0i}|}\right|_{dB}\right] \tag{4}$$

In deciding the resulting maxgain it should be considered that the resulting feedback signal in the output of a combiner as the directional processing means will be:

$U=c_1(U_1+X_1)-c_2(U_2+X_2)$, having a feedback component of $X=c_1X_1-c_2X_2$. Accordingly, the maxgain as seen on the output of the combiner can be calculated as:

$$\text{max gain} = -\left|\frac{X(j\omega)}{Y_0(j\omega)}\right|_{dB} = -\left|\frac{c_1X_1(j\omega)-c_2X_2(j\omega)}{Y_0(j\omega)}\right|_{dB} \quad (5)$$

According to an embodiment of the present invention, the hearing aid comprises more than two microphones. Thus, the resulting acoustic feedback signal X(jω) would be calculated according to:

$$x(j\omega)=c_1X_1(j\omega)+c_2X_2(j\omega)+c_3X_3(j\omega)+\ldots \quad (6)$$

The coefficient set $c_1, \ldots, c_n$ is also determined according to how the signals are combined by the directional processing means in order to generate the directional or spatially filtered signal.

According to an embodiment, in order to reduce the artifacts that occur when gain-values close to the maxgain is applied, some safety margin ($M_{dB}$) is utilized. Since high feedback levels are more likely to occur in some frequency-bands than others, according to an embodiment, the safety margin depends on frequency. Thus:

$$\begin{aligned}\text{max gain} &= -\left|\frac{X(j\omega)}{Y_0(j\omega)}\right|_{dB} - M_{dB}(j\omega) \\ &= -\left|\frac{c_1X_1(j\omega)-c_2X_2(j\omega)}{Y_0(j\omega)}\right|_{dB} - M_{dB}(j\omega)\end{aligned} \quad (7)$$

Typical values for $M_{dB}$ are in the range of 0 dB to 12 dB.

While this expression is quite demanding to evaluate in real-time, some simplification may be obtained by assuming according to an embodiment, that the two estimates ($X_1$, $X_2$) are identical. This could be a fairly good estimate for closely located microphones and/or for relatively low frequency bands. Other ways of reducing the system load would be to abandon the request for real-time updates of the maxgain-estimate and, thus, operate at a slower speed, e.g. 500 ms intervals. Naturally, such measures may be applied to all embodiments of the invention.

According to an embodiment, in situations where it is determined, by other measures, that the estimates of the feedback signals may not be correct, the updating of the maxgain estimates could be halted and the current value of the derived maximum gain limit used until the next update.

According to another embodiment, during power-up of the hearing aid, a conservative maximum gain limit value could be maintained and used for the hearing loss compensation signal calculation until the maxgain estimation system is fully operative.

According to still another embodiment, the maximum gain limit is derived from values of the first and second acoustic feedback signals derived once during fitting of said hearing aid and the current mixing ratio. The first and second acoustic feedback signals then only need to be estimated ones, e.g. as part of a feedback test regularly carried out during a fitting session or in more or less regular intervals.

The current mixing ratio is however determined from the current directional characteristic. According to an embodiment it may be computed continuously.

As the reference signal Y, the signal processor output signal 6 may be used. According to another embodiment and as illustrated in FIG. 2, the filter input signal 9 is derived from the processor output signal 6 through delay in a delay unit 12.

The whole architecture may be wholly or partially band-split, i.e. one of the adaptive filters 7, 27 or the signal processor 4, or both, may operate in several frequency bands. It is known to the skilled person how this is to be achieved.

Figure 3:
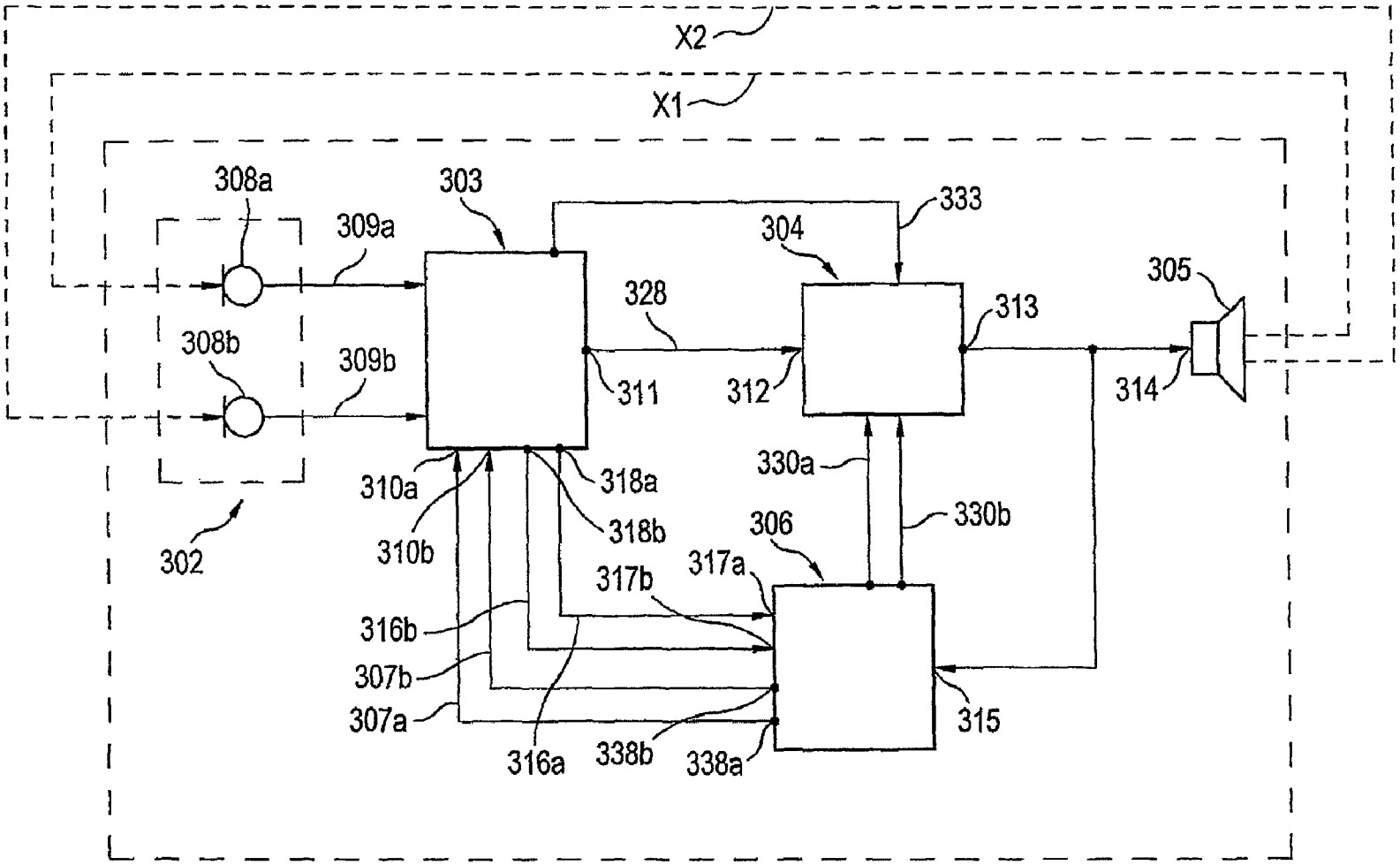
FIG. 3 is a schematic block diagram of a hearing aid according to a second embodiment of the present invention.

Reference is now made to FIG. 3, which shows a hearing aid 300 according to a second embodiment of the present invention. It comprises a microphone array 302, an input processor 303, a main signal processor 304, an output transducer 305, and a feedback signal estimator 306 for generation of feedback compensation signals 307*a*, 307*b* and estimated feedback signals 330*a*, 330*b*. The feedback compensation signals 307*a*, 307*b*, which are estimated feedback signal, are transferred from the outputs 338*a*, 338*b* of the feedback signal estimator 306 to the compensation inputs 310*a*, 310*b* on the input processor 303. The microphone array 302 comprises two microphones 308*a*, 308*b*, each microphone being connected to the input processor through a respective connection 309*a*, 309*b*. The input processor combines the two acoustic input signals from the microphones 308*a*, 308*b* forming a spatial signal 331 according to a mixing ratio. The first output 311 of the input processor 303 is connected to the input 312 of the main signal processor 304 transmitting the spatial signal 331, while the main signal processor 304 output signal as hearing loss compensation signal 314 is fed to the input of the output transducer 305 and to the input 315 of the feedback signal estimator 306. The feedback signal estimator 306 receives feedback compensated signals 316*a*, 316*b* from the second outputs 318*a*, 318*b* of the input processor 303 at the control inputs 317*a*, 317*b* of the feedback signal estimator. The main signal processor receives the estimated feedback signals 330*a*, 330*b* from the feedback signal estimator 306 and the mixing ratio through connection 333 from the input processor 303. The hearing aid compensation signal 314 is calculated from the spatial signal 331 by applying a gain that does not exceed a maximum gain limit derived from the mixing ratio 333 and the estimated feedback signals 330*a*, 330*b*. FIG. 3 also shows the acoustic feedback paths X1, X2 that exist between the output transducer 305 and each of the microphones 308*a*, 308*b*. The output transducer is preferably an ordinary type hearing aid receiver.

According to an embodiment, the input transducers 308*a*, 308*b*, are omni-directional microphones. In other embodiments some, or all, of the microphones may alternatively be directional microphones, which are thus included in the microphone array. It is also well known to the skilled person that microphone arrays for hearing aids may comprise more than two microphones. However, considering the costs of using more than two microphones in terms of the added complexity of the circuitry needed to include such additional microphones in the array, the embodiment with only two microphones 308*a*, 308*b* is presently preferred.

The hearing aid 300 may be of the multi-band type, i.e. it is adapted for dividing the full audible frequency spectrum into several bands for individual processing. In such a hearing aid, several, possibly all, bands may comprise an input processor 303 according to the invention, whereby an improved functionality of the directional system may be obtained. Alternatively, an input processor 303, according to the invention, may be utilized as a single band front end to the multi-band system.

Figure 4:
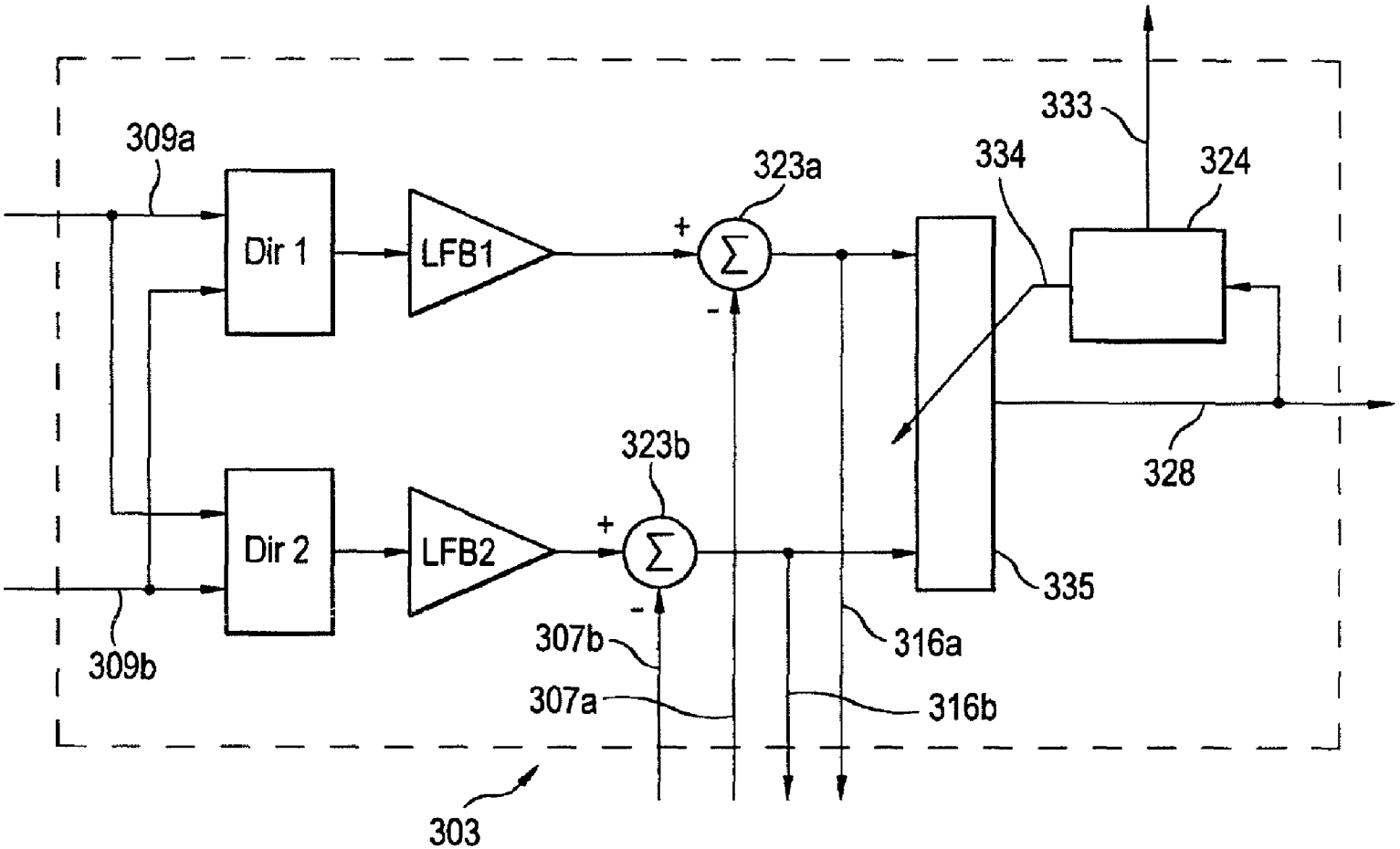
FIG. 4 is a schematic block diagram of a directional controller according to an embodiment of the present invention.

Reference is now made to FIG. 4, which shows in more detail the input processor 303 for two input channels with two directional controllers Dir1, Dir2, according to an embodiment of the present invention. Each of these directional controllers receives acoustic input signals 309*a*, 309*b* from the microphones 308*a*, 308*b*. According to an embodiment, processing of the input signals prior to the directional controllers includes deriving signals from two microphone outputs, digitizing and then matching by a microphone matching system. Each of the directional controllers generates a fixed directional characteristic. After processing in these directional controllers the signals may be subjected to low frequency boost in the amplifiers (LFB). Further details will be described below with reference to FIG. 6.

The signals thus generated are then combined in combining means implemented by respective adders 323*a*, 323*b* with corresponding feedback compensating signals 307*a*, 307*b*. According to an embodiment, the feedback compensating signals 307*a*, 307*b* are further processed estimated feedback signals which are subtracted by the adders from the outputs of the directional controllers Dir1, Dir2. These corresponding feedback compensating signals may be generated by estimation means similar to the feedback signal estimator 306 as illustrated in FIG. 3.

The feedback compensated signals 316*a*, 316*b* are made available for use as control input(s) to the feedback signal estimator(s) and for processing in a signal combiner 335. Adaptive controller 324 adaptively controls this combiner 335, such that a cost-function, e.g. the signal power of the output signal 333, is minimized. When controlling the combiner 335, the adaptive controller also determines the directional characteristic of the spatial signal 328 by adjusting the mixing ratio between the two feedback compensated signals 316*a*, 316*b* input to the combiner. The adjusted mixing ratio is then also supplied as signal 333 to the main signal processor 304 to calculate to maximum gain limit. The preferred design of the signal combiner 335 according to an embodiment is shown in detail in FIG. 5.

The directional controllers Dir1, Dir2 are designed to achieve that a combination in combiner 335 of their respective output signals will generate a directional characteristic according to the mixing ratio in which they are combined. The adaptive control 324 dynamically adapts the combination ratio of the signal combiner 335 so as to produce a combination output signal that minimizes the environmental noise received by the hearing aid microphone system. Preferably, a first one of the directional controllers Dir1, Dir2 is adapted to produce a bi-directional characteristic while a second one produces an omni-directional characteristic.

This arrangement avoids incorporating the complex and time-varying component of an adaptively controlled, equalized directional controller into the part of the feedback path that needs to be estimated by the feedback signal estimator, and thereby eases the function requirements to the feedback estimator. In the embodiment of FIG. 4, fixed directional controllers are arranged first in the processing chain, then low-frequency boosters, and then adders for feedback compensation, while the desired adaptive directional property is achieved in a subsequent stage by a weighted mixing of the outputs of several of such systems. Hereby the adaptive part of the directional controller is placed outside of the part of the feedback path to be estimated by the feedback estimator.

In a variation of this embodiment, more than two directional controllers Dir1, Dir2 may be utilized. For this, the signal combiner 335 will be modified to combine a corresponding number of input signals. Accordingly, the adaptive controller 324 will optimize the vector that controls the signal combiner 335 such that the cost-function is minimized, contrary to the situation with two directional controllers, where a scalar is minimized. Methods for this are readily available in the prior art, and are considered well known to the skilled person. However, since the use of more than two directional controllers requires generation of more than two feedback-compensating signals, it is presently preferred to apply just two directional controllers.

Figure 5:
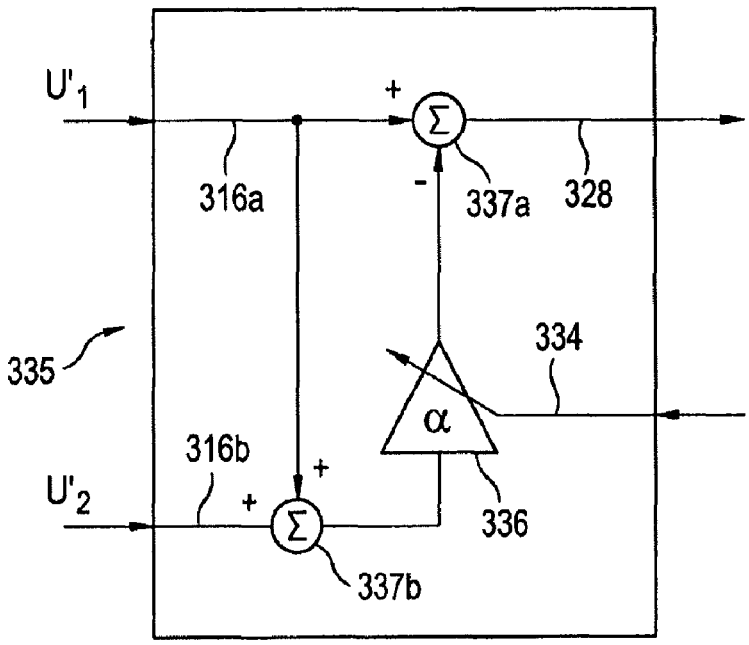
FIG. 5 is a schematic block diagram of a signal combiner controller according to an embodiment of the present invention.

In FIG. 5, an embodiment of the signal combiner 335 is shown. In this, preferred, mode of operation, the first directional signal 316*a* is assumed to exhibit a bi-directional characteristic (Dir1), while the second directional signal 316*b* is assumed to exhibit an omni-directional characteristic (Dir2). By subtracting an adaptively attenuated signal—derived from the amplified output signal of the second adder 337*b* according to the controlled amplifier 336—from the bi-directional signal 316*a* in the first adder 337*a*, an adaptively controlled spatial signal 328 with the desired directional characteristic will be obtained according to formula 12 (see below). Thus, the combiner is capable of effectively outputting a spatial signal according to a wide range of directional sensitivity patterns. Further description may be found in WO-A-02/085066.

It will be obvious to the skilled person, that the bi-directional characteristic used in this embodiment, is to be generated by subtracting the back-microphone signal from the front-microphone signal.

Figure 6:
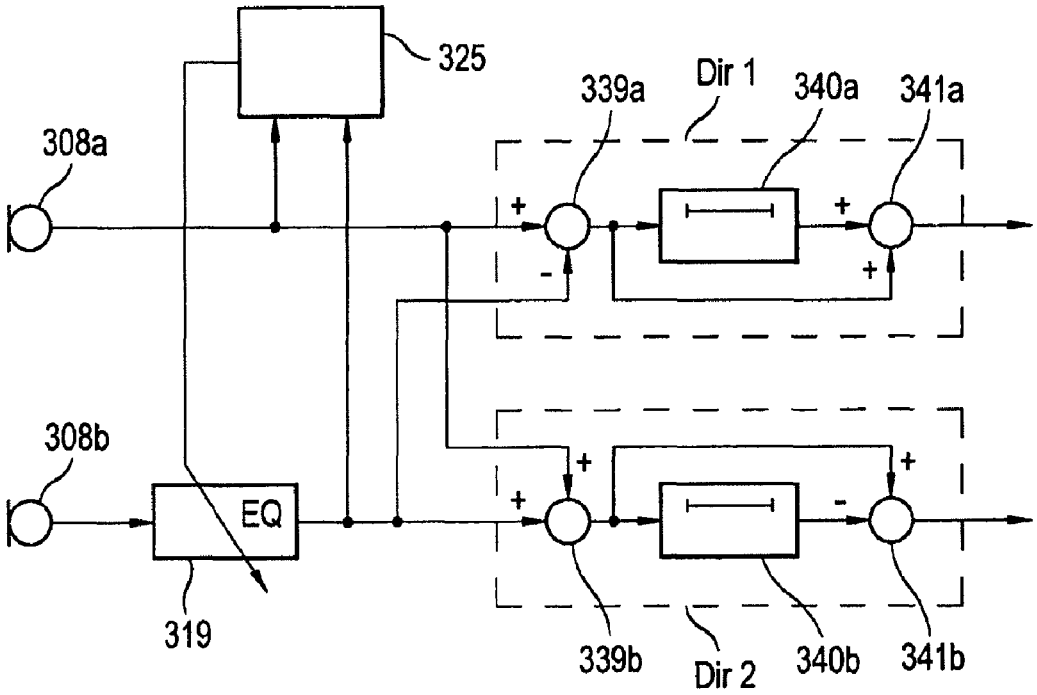
FIG. 6 is a schematic block diagram of an input controller according to an embodiment of the present invention.

Reference is now made to FIG. 6, which shows details of the input processor 303 of the embodiment shown in FIG. 4. FIG. 6 shows the microphones 308*a*, 308*b*, matching amplifier 319*b*, matching controller 325, and directional controllers Dir1, Dir2. The directional controllers each includes a set of first adding circuit 339*a*, 339*b*, phase delay device 340*a*, 340*b*, and second adding means 341*a*, 341*b*. Thus, each of the directional controllers outputs a signal according to a respective fixed sensitivity pattern, and adaptation of directivity is obtained further downstream by appropriate processing of the signals output by the directional controllers (see also FIG. 4).

It will now be described in detail how the feedback compensated signals 316*a*, 316*b* from the fixed directional sensors Dir1, Dir2 are combined by the combiner 335 generating an output signal 328 (U').

In a preferred embodiment the directional characteristic Dir1 is a bi-directional characteristic, while that of Dir2 is an omni-directional characteristic. In this situation it is preferred that the coefficients $[c_1, c_2]=[(1-\alpha), \alpha]$.

Accordingly, in this embodiment the combination is done by combining a version of the one signal $U'_1$ in one branch 316*a* with a scaled version of the other signal $U'_2$ in the other branch 16*b* according to: $U'=(1-\alpha)U'_1-\alpha U'_2$, ($\alpha$ being a scalar in the range 0 . . . 1), wherein the required delay has been achieved in the directional sensors (Dir1, Dir2).

In deciding the resulting maxgain it should be considered that if according to an embodiment no feedback compensation was applied, the resulting feedback signal in the output of the combiner 335 would be:

$$U_{spatial}=(1-\alpha)(U_1+X_1)-\alpha(U_2+X_2), \tag{8}$$

having a feedback component of $X=(1-\alpha)X_1-\alpha X_2$.

Accordingly, the maxgain as seen on the output of the combiner 335 can be calculated as:

$$\begin{aligned}\text{max gain} &= -\left|\frac{X(j\omega)}{Y_0(j\omega)}\right|_{dB} - M_{dB}(j\omega) \\ &= -\left|\frac{(1-\alpha)X_1(j\omega)-\alpha X_2(j\omega)}{Y_0(j\omega)}\right|_{dB} - M_{dB}(j\omega)\end{aligned} \tag{9}$$

This expression, however, is costly to evaluate. Assuming that the signals are completely uncorrelated, a safe estimate may be calculated as:

$$\text{max gain} = -\left|\frac{X(j\omega)}{Y_0(j\omega)}\right|_{dB} \approx -\left|(1-\alpha)\left|\frac{X_1(j\omega)}{Y_0(j\omega)}\right| + \alpha\left|\frac{X_2(j\omega)}{Y_0(j\omega)}\right|\right|_{dB} \quad (10)$$

i.e. an interpolation of the maxgains in each branch.

In the band-split version, according to an embodiment which is particularly preferred, this would be:

$$\text{max gain} \approx -\left|(1-\alpha)\frac{|X_{1i}|}{|Y_{0i}|} + \alpha\frac{|X_{2i}|}{|Y_{0i}|}\right|_{dB} - M_{dBi} \quad (11)$$

Taking into consideration that feedback cancellation is done as illustrated in FIGS. 3 and 4, the spatially filtered output signal from the combiner 335, will be:

$$U_{spatial}=(1-\alpha)(U'_1+X_1)-\alpha(U'_2+X_2) \quad (12)$$

with $U'_1=U_1-X_1$, $X_1$ being the estimated feedback signal in the first branch of microphone 308*a* and $U'_2=U_2-X_2$, $X_2$ being the estimated feedback signal in the second branch of microphone 308*b*.

Empirically, the effect of feedback cancellation is an increase in the gain margin on the order of 20 dB. Accordingly, the maxgain safety margin ($M_{dB}$) may be set at e.g. −8 dB (−20 dB on account of cancellation+12 dB on account of the safety margin mentioned in the previous embodiment), such that maximum available gain is set 8 dB higher than the maxgain estimation based on the calculation on the adaptive filters.

In respect of the safety margin mentioned in the first embodiment, since the assumption above of uncorrelated signals may provide an estimate which is conservatively low, the safety margin—in this second embodiment—may be set at a negative value, e.g. −3 dB, such that $M_{dB}=-23$ dB.

Further, since acoustic feedback rarely occurs in the lower frequency bands, the maxgain estimation may be omitted for those bands, according to an embodiment.

According to a third embodiment of the present invention, the input sensors Dir1, Dir2 as shown in FIG. 4 above are replaced by omni-directional microphones, thus, the combining factor $\alpha$ will no longer be a scalar but a complex number. Accordingly, the maxgain as seen on the output of the combiner 335 may be evaluated according to:

$$\text{max gain} = -\left|\frac{X(j\omega)}{Y_0(j\omega)}\right|_{dB} = -\left|\frac{c_1X_1(j\omega)-c_2X_2(j\omega)}{Y_0(j\omega)}\right|_{dB} - M_{dB}(j\omega) \quad (13)$$

This embodiment is quite like the first embodiment, with the exception that the feedback estimates are subtracted from the signal processor input. In this respect, the system operates like that of the second embodiment and, consequently, the safety margin ($M_{dB}$) is to be determined according to the description for that embodiment.

Figure 7:
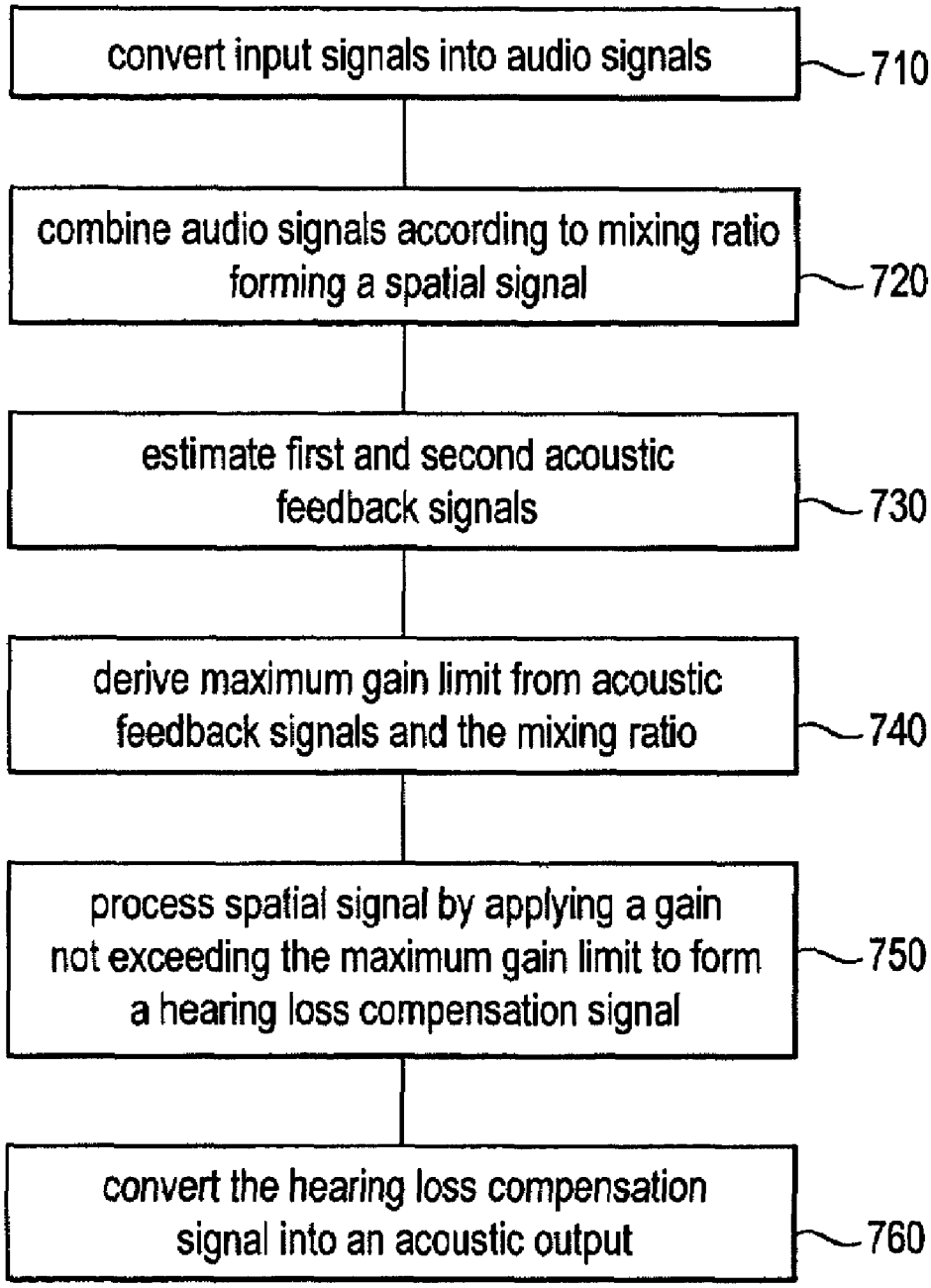
FIG. 7 is a flow diagram of a method according to an embodiment of the present invention.

Reference is now made to FIG. 7, which shows a flow diagram of a method according to an embodiment of the present invention which does not employ feedback cancellation. In step 710, the microphone input signals are converted into separate audio signals by the input transducers. The audio signals are then combined in step 720 according to a mixing ratio to form a spatial signal having a directional characteristic. The mixing ratio is adjusted according to user settings or adaptively controlled by an adaptive filter. In step 730, acoustic feedback signals entering the input transducers are estimated for each microphone branch. Based on the mixing ratio and the acoustic feedback signals, a maximum gain limit is derived in step 740 which should prevent or at least reduce disturbing sounds due to acoustic feedback from the acoustic output signal of the hearing aid. The spatial signal is then processed in step 750 by applying a gain which is adjusted to not exceeding the maximum gain limit to form a hearing loss compensation signal. In step 760, the hearing loss compensation signal is converted into the acoustic output signal reaching the ear of the user.

In this embodiment no estimation of the feedback path is performed. Rather, characteristics of each feedback path are calculated from the estimated acoustic feedback signals. According to a particular embodiment, the estimation of the feedback paths is done during the fitting of the hearing aid to the particular user, e.g. during a normal fitting session. The values of the calculated attenuation are then used to derive a maxgain value which is stored as default or conservative maximum gain limit in the hearing aid. Consequently, during normal operation of the hearing aid, changes in the way the input-sensor signals is combined, e.g. by changing the directional characteristic, the corresponding, changed, maxgain value can be calculated, according to step 740, by using these stored maxgain values.

All appropriate combinations of features described above are to be considered as belonging to the invention, even if they have not been explicitly described in their combination.

According to embodiments of the present invention, the hearing aids described herein may be implemented on signal processing devices suitable for the same, such as, e.g., digital signal processors, analogue/digital signal processing systems including field programmable gate arrays (FPGA), standard processors, or application specific signal processors (ASSP or ASIC). Obviously, it is preferred that the whole system is implemented in a single digital component even though some parts could be implemented in other ways—all known to the skilled person.

Hearing aids, methods and devices according to embodiments of the present invention may be implemented in any suitable digital signal processing system. The hearing aids, methods and devices may also be used by, e.g., the audiologist in a fitting session. Methods according to the present invention may also be implemented in a computer program containing executable program code executing methods according to embodiments described herein. If a client-server-environment is used, an embodiment of the present invention comprises a remote server computer which embodies a system according to the present invention and hosts the computer program executing methods according to the present invention.

According to another embodiment, a computer program product like a computer readable storage medium, for example, a floppy disk, a memory stick, a CD-ROM, a DVD, a flash memory, or any other suitable storage medium, is provided for storing the computer program according to the present invention. According to a further embodiment, the program code may be stored in a memory of a digital hearing device or a computer memory and executed by the hearing aid device itself or a processing unit like a CPU thereof or by any other suitable processor or a computer executing a method according to the described embodiments.

When referring to the spatial signal also the terms spatially filtered signal and directional signal have been used herein which all refer to the same concept and, therefore, may be used interchangeably if not explicitly otherwise stated herein and which is also readily apparent to the skilled person.

Having described and illustrated the principles of the present invention in embodiments thereof, it should be apparent to those skilled in the art that the present invention may be modified in arrangement and detail without departing from such principles. Changes and modifications within the scope of the present invention may be made without departing from the spirit thereof, and the present invention includes all such changes and modifications.

What is claimed is:

1. A hearing aid, comprising:

a first microphone for converting sound into a first audio signal;

a second microphone for converting sound into a second audio signal;

directional processing means for combining said first and said second audio signal according to a mixing ratio to form a spatial signal;

estimating means for providing estimate of a first acoustic feedback signal entering said first microphone and an estimate of a second acoustic feedback signal entering said second microphone;

processing means for processing said spatial signal by applying a gain not exceeding a maximum gain limit to form a hearing loss compensation signal;

wherein said maximum gain limit is derived from the estimate of said first and second acoustic feedback signals and said mixing ratio; and an output transducer for converting said hearing loss compensation signal into an acoustic output.

2. The hearing aid according to claim 1, wherein said estimating means comprises for each of said first and second microphone branch an adaptive filter each being adapted to generate a respective estimate of said respective acoustic feedback signal by minimizing cross-correlation between said hearing loss compensation signal and said respective audio signal.

3. The hearing aid according to claim 1, wherein said estimating means is further adapted to estimate a respective first and second maximum gain limit from said first and second acoustic feedback signal, and said processing means is further adapted to derive said maximum gain limit by interpolating said first and second maximum gain limit.

4. The hearing aid according to claim 1, wherein said processing means is further adapted to calculate a resulting acoustic feedback signal by interpolating said estimated acoustic feedback signals according to said mixing ratio, and by determining said maximum gain limit from the ratio of said resulting acoustic feedback signal to said hearing loss compensation signal.

5. The hearing aid according to claim 4, wherein said processing means is adapted to calculate said resulting maximum gain limit by applying the formula:

$$\text{max gain} = -\left|\frac{X(j\omega)}{Y_0(j\omega)}\right|_{dB} - M_{dB}(j\omega)$$
$$= -\left|\frac{c_1X_1(j\omega) - c_2X_2(j\omega)}{Y_0(j\omega)}\right|_{dB} - M_{dB}(j\omega);$$

with: maxgain representing the maximum gain limit;

$X_1$ representing said estimate of the first acoustic feedback signal;

$X_2$ representing said estimate of the second acoustic feedback signal;

$c_1$, $c_2$ representing coefficients according to said mixing ratio in a resulting acoustic feedback signal: $X=c_1X_1-c_2X_2$;

$Y_0$ representing said hearing loss compensation signal; and

M representing a safety margin in [dB].

6. The hearing aid according to claim 1, comprising at least one additional microphone for converting sound into an additional audio signal, and wherein said estimating means is adapted to estimate an additional acoustic feedback signal entering said additional microphone, wherein said directional processing means is adapted to form said spatial signal also based on said additional audio signal according to said mixing ratio, and said processing means is adapted to derive said maximum gain limit also from said additional acoustic feedback signal according to said mixing ratio.

7. The hearing aid according to claim 3, wherein said maximum gain limit is derived from values of said first and second acoustic feedback signals derived during fitting of said hearing aid and said current mixing ratio.

8. A hearing aid comprising:

a first microphone for converting sound into a first audio signal;

a second microphone for converting sound into a second audio signal;

estimating means for estimating a first acoustic feedback signal entering said first microphone to generate a first estimated feedback signal and for estimating a second acoustic feedback signal entering said second microphone to generate a second estimated feedback signal;

combining means for combining said first audio signal with said first estimated feedback signal and said second audio signal with said second estimated feedback signal to form first and second feedback compensated audio signal;

processing means for combining said first and second feedback compensated audio signals according to a mixing ratio to form a hearing loss compensation signal by applying a gain not exceeding a maximum gain limit; wherein said maximum gain limit is derived from said first and second estimated feedback signals and said mixing ratio; and an output transducer for converting said hearing loss compensation signal into an acoustic output.

9. The hearing aid according to claim 8, comprising:

an adaptive directional controller for controlling said processing means by adjusting said mixing ratio in order to provide spatial adaptation of said hearing loss compensation signal.

10. The hearing aid according to claim 8, comprising:

first directional processing means for combining the first and the second audio signal to form a first spatial signal;

second directional processing means for combining the first and the second audio signal to form a second spatial signal;

wherein said combining means is adapted for combining said first spatial signal with said first estimated feedback signal and said second spatial signal with said second estimated feedback signal to form first and second feedback compensated spatial signal; and said processing means is adapted for combining said first and second feedback compensated spatial signals to form said hearing loss compensation signal.

11. The hearing aid according to claim 10, wherein said first directional processing means forms said first spatial signal having a fixed bi-directional characteristic, and wherein said second directional processing means forms said second spatial signal having a fixed omni-directional characteristic.

12. The hearing aid according to claim 10, wherein said processing means is adapted to calculate said maximum gain limit by applying the formula:

$$\text{max gain} = -\left|\frac{X(j\omega)}{Y_0(j\omega)}\right|_{dB} \approx -\left|(1-\alpha)\left|\frac{X_1(j\omega)}{Y_0(j\omega)}\right| + \alpha\left|\frac{X_2(j\omega)}{Y_0(j\omega)}\right|\right|_{dB}$$

with: maxgain representing the maximum gain limit;

$X_1$ representing said estimate of the first acoustic feedback signal;

$X_2$ representing said estimate of the second acoustic feedback signal;

$\alpha$ being a scalar in the range 0, . . . , 1 according said mixing ratio in a resulting acoustic feedback signal: $X=(1-\alpha)X_1-\alpha X_2$; and $Y_0$ representing said hearing loss compensation signal.

13. The hearing aid according to claim 8, comprising filtering means for converting said first and second audio signal into band-split audio signals of a plurality of frequency bands and wherein said hearing aid is adapted to further process said band-split audio signals in each of said frequency bands independently, and wherein said processing means is adapted to calculate said maximum gain limit by applying the formula:

$$\text{max gain} \approx -\left|(1-\alpha)\frac{|X_{1i}|}{|Y_{0i}|} + \alpha\frac{|X_{2i}|}{|Y_{0i}|}\right|_{dB} - M_{dBi}$$

with: maxgain representing the maximum gain limit;

$X_{1i}$ representing said estimate of the first acoustic feedback signal in frequency band i;

$X_{2i}$ representing said estimate of the second acoustic feedback signal in frequency band i;

$\alpha$ being a scalar in the range 0, . . . , 1 according said mixing ratio in a resulting acoustic feedback signal: $X_i=(1-\alpha)X_{1i}-\alpha X_{2i}$;

$Y_{0i}$ representing said hearing loss compensation signal in frequency band i; and $M_{dBi}$ representing a safety margin in [dB] in frequency band i.

14. A method of processing signals from a first and a second microphone in a hearing aid, comprising:

converting input signals from the first and the second microphones into a first and a second audio signal;

combining said first and said second audio signal according to a mixing ratio to form a spatial signal;

providing an estimate of a first acoustic feedback signal entering said first microphone and an estimate of a second acoustic feedback signal entering said second microphone;

processing said spatial signal by applying a gain not exceeding a maximum gain limit to form a hearing loss compensation signal; wherein said maximum gain limit is derived from the estimates of said first and second acoustic feedback signals and said mixing ratio; and converting said hearing loss compensation signal into an acoustic output.

15. The method according to claim 14, wherein said method is part of a fitting routine of said hearing aid to a particular user, further comprising the step of storing characteristics of said first and second acoustic feedback signal in said hearing aid by using a programming interface of said hearing aid.

16. The method according to claim 14, further comprising the step of adapting said mixing ratio in order to provide adaptation of said hearing loss compensation signal automatically by minimizing said acoustic output.

17. The method according claim 14, wherein said maximum gain limit is derived by applying the formula:

$$\text{max gain} = -\left|\frac{X(j\omega)}{Y_0(j\omega)}\right|_{dB} - M_{dB}(j\omega) = -\left|\frac{c_1X_1(j\omega) - c_2X_2(j\omega)}{Y_0(j\omega)}\right|_{dB} - M_{dB}(j\omega);$$

with: maxgain representing said maximum gain limit;

$X_1$ representing said estimate of the first acoustic feedback signal;

$X_2$ representing said estimate of the second acoustic feedback signal;

$c_1$, $c_2$ representing coefficients according to said mixing ratio in a resulting acoustic feedback signal: $X=c_1X_1-c_2X_2$;

$Y_0$ representing said hearing loss compensation signal; and

M representing a safety margin in [dB].

18. The method according to 14, wherein said signals from said first and a second microphone are filtered into band-split signals and independently processed in different frequency bands.

19. The method according to claim 14, wherein said maximum gain limit is derived by the steps of:

calculating a resulting acoustic feedback signal by interpolating said estimated acoustic feedback signals according to said mixing ratio; and determining said maximum gain limit from the ratio of said resulting acoustic feedback signal to said hearing loss compensation signal.

20. A computer program product, containing executable program code which, when executed on a computer, executes a method of processing signals from a first and a second microphone in a hearing aid, comprising:

converting input signals from the first and the second microphones into a first and a second audio signal;

combining said first and said second audio signal according to a mixing ratio to form a spatial signal;

providing an estimate of a first acoustic feedback signal entering said first microphone and an estimate of a second acoustic feedback signal entering said second microphone;

processing said spatial signal by applying a gain not exceeding a maximum gain limit to form a hearing loss compensation signal; wherein said maximum gain limit is derived from the estimates of said first and second acoustic feedback signals and said mixing ratio; and converting said hearing loss compensation signal into an acoustic output.

* * * * *